United States Patent [19]

Ogihara et al.

[11] 4,444,511

[45] Apr. 24, 1984

[54] MODE SWITCHING DEVICE IN AN ELECTRONIC TIMEPIECE

[75] Inventors: Masuo Ogihara; Nobuo Shinozaki; Tadashi Ishikawa; Yoichi Seki, all of Shikawatashi, Japan

[73] Assignee: Seiko Koki Kabushiki Kaisha, Tokyo, Japan

[21] Appl. No.: 290,088

[22] Filed: Aug. 4, 1981

[30] Foreign Application Priority Data

Aug. 7, 1980 [JP] Japan ..... 55-108523

[51] Int. Cl.[3] ..... G04B 19/30

[52] U.S. Cl. ..... 368/69; 368/70; 368/185; 368/190

[58] Field of Search ..... 368/185, 187, 188, 190, 368/69, 70, 29, 30; 200/5 B, 5 C, 5 D, 5 E, 50 C

[56] References Cited

U.S. PATENT DOCUMENTS 3,227,847 1/1966 Blodgett ..... 200/5 B 3,733,810 5/1973 Girard ..... 368/29

3,768,247 10/1973 Fujita ..... 368/187 X

*Primary Examiner*—Ulysses Weldon

*Attorney, Agent, or Firm*—Robert E. Burns; Emmanuel J. Lobato; Bruce L. Adams

[57] ABSTRACT

An electronic watch having a multiple of modes includes mode selection means operable from the outside and a plurality of external operating buttons for modifying the contents of indication of the watch or for issuing an operational command in each mode. Auxiliary indication means is provided directly with the mode selection means. Alternatively, the auxiliary indication means may be provided separately from the mode selection means but in an interlocked fashion with it. The indication surface of the auxiliary indication means carries at a position corresponding to each of the external operating buttons a symbol or characters which represent the function of said each of the external operating buttons in each selected mode.

9 Claims, 9 Drawing Figures

MODE SWITCHING DEVICE IN AN ELECTRONIC TIMEPIECE

BACKGROUND OF THE INVENTION

This invention relates to a mode switching device in an electronic timepiece having a multitude of modes, and more particularly, it is intended to simplify the operation of each external operating switch-button in each mode whenever it is desired to switch over from one mode to another mode.

In recent years, multi-mode electronic timepieces having not only the time-indicating function, but also many other functions such as calendar, alarm, timer and stopwatch functions, have been introduced into the market. Heretofore, however, many external operating switch-buttons have been provided and many functions allocated to those buttons, so the user is required to remember each predetermined function of each button for operating the timepiece, which is very troublesome in operation.

SUMMARY OF THE INVENTION

This invention aims at providing a device free from the above-mentioned drawbacks and capable of performing the operation of the aforesaid buttons in a simple manner.

According to this invention, the above object is attained by constructing the multi-mode timepiece so that second indication means for indicating the contents of operation of the aforesaid buttons is interlocked with a mode selection member which performs a mode switching operation, with marks put on the second indication means being visible from indication windows, so that the external operating buttons are provided in corresponding relation to each indication window thereby indicating the function of each external operating switch-button in each mode.

DETAILED DESCRIPTION OF THE PREFERRED EMBODIMENTS

Figure 1:
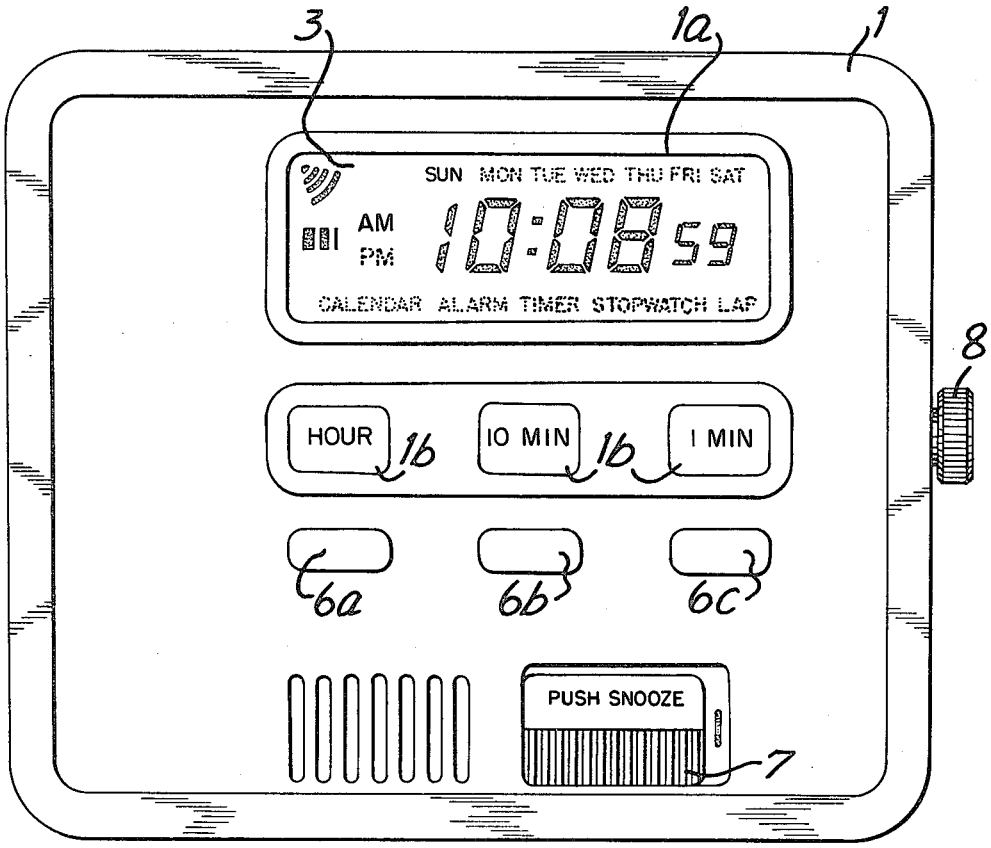
FIG. 1 is a plan view of a mode switching device according to an embodiment of this invention.
Figure 2:
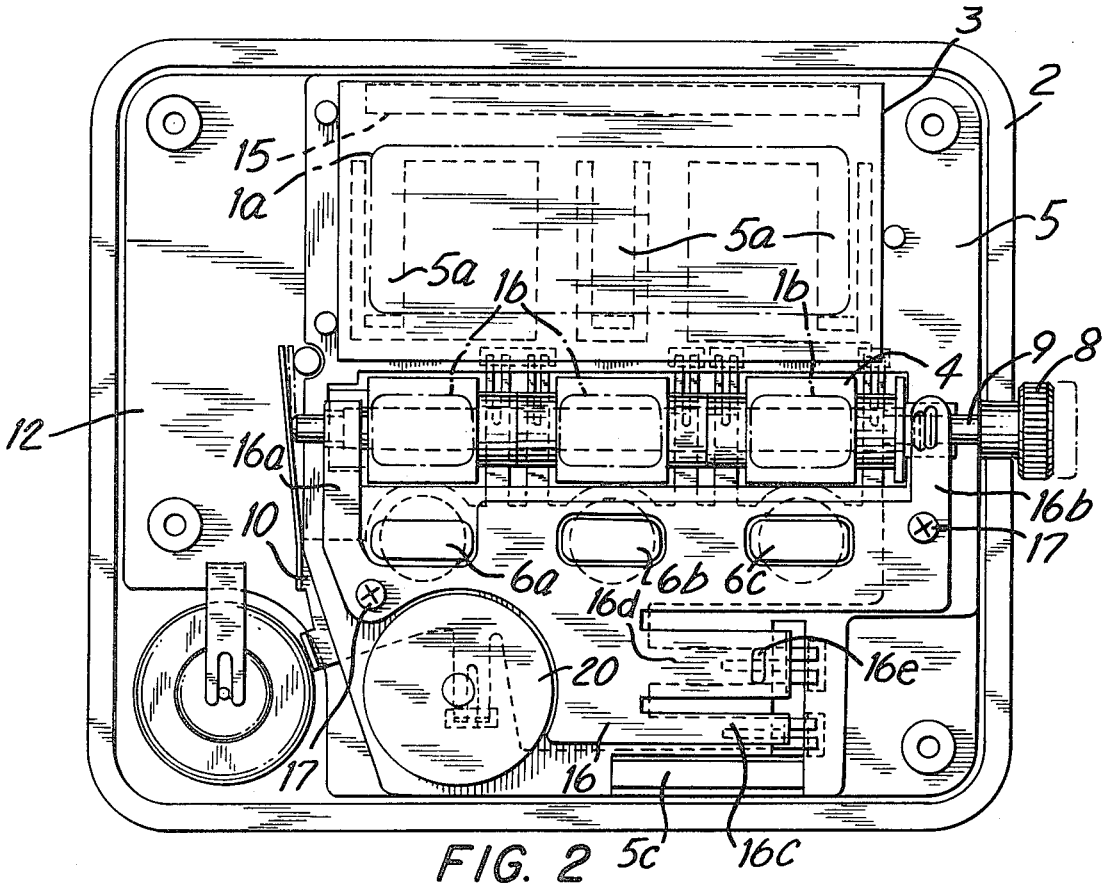
FIG. 2 is a plan view of the interior thereof.
Figure 3:
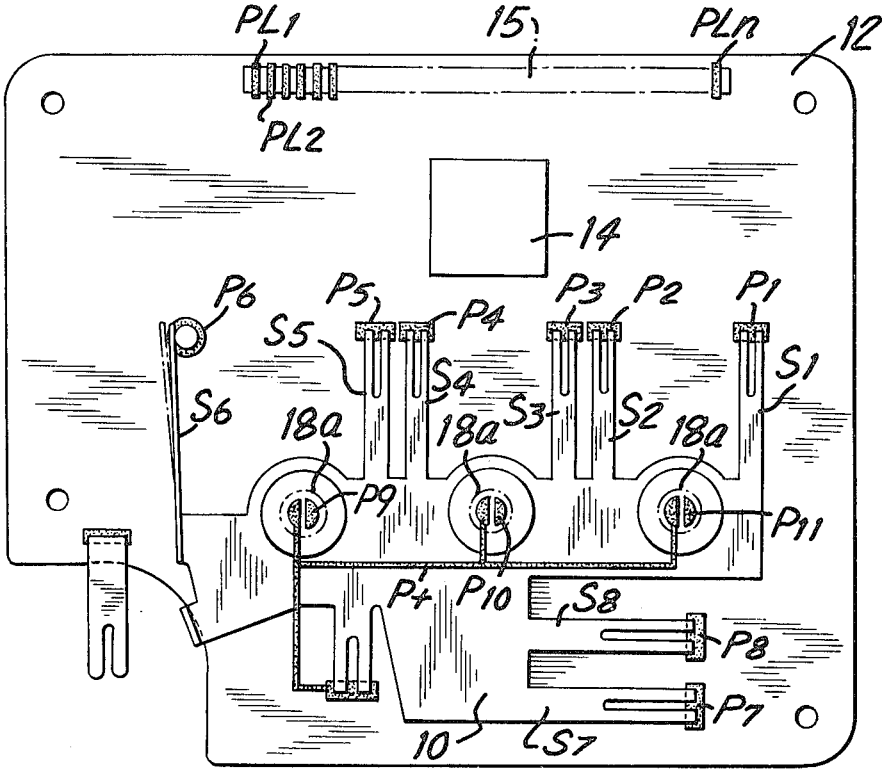
FIG. 3 is a partial plan view of the interior thereof.
Figure 4:
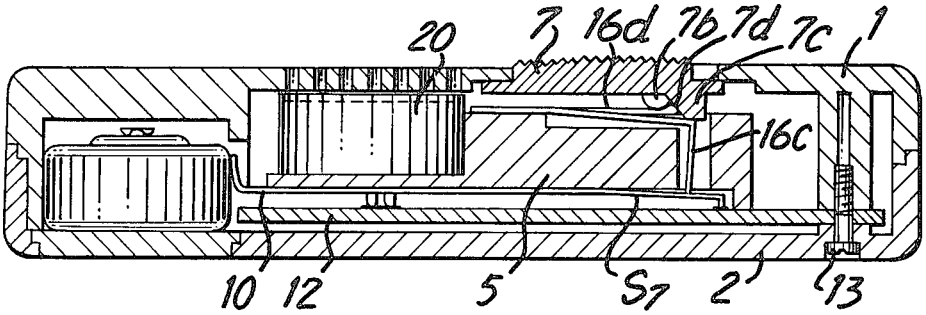
FIG. 4 is a partial sectional view of FIG. 1.
Figure 5:
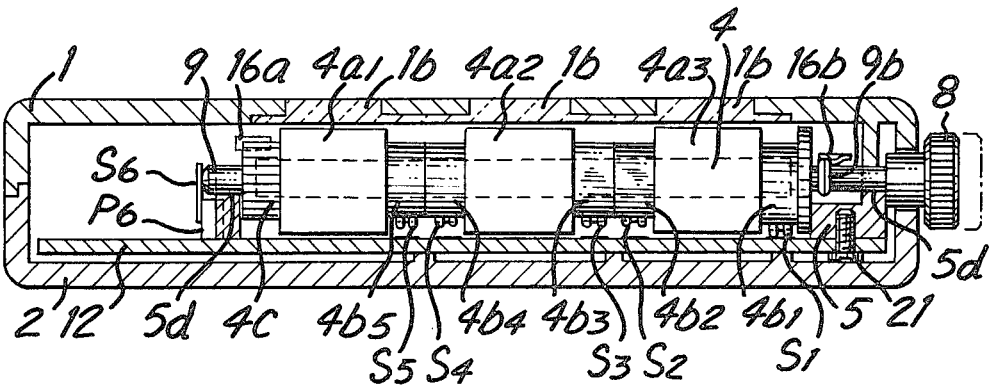
FIG. 5 is a partial sectional view of FIG. 1.

An embodiment of this invention will be described in detail hereinunder with reference to FIGS. 1 through 7.

An upper case 1 and a lower case 2 both constituting a housing of a timepiece are each formed of a plastic material, with the upper case 1 having a main indication window for a liquid crystal display panel 3 and three sub-indication windows 1*b* for an indication drum 4 as will be described later. An inner plate 5 formed of a plastic material is provided at an intermediate portion thereof with three resilient arms 5*a* for urging the liquid crystal display panel 3 to the upper case 1, and further provided with three first guide portions 5*b* for guiding three first, second and third external operating push buttons 6*a*, 6*b*, 6*c* in a vertically movable manner, a second guide portion 5*c* for guiding an alarm button 7 so as to be movable right and left and pivotable about itself, and two U-shaped grooves 5*d* for supporting both ends of a selector shaft 9 which has a knob at its rightmost end, the selector shaft 9 extending through the indication drum 4.

On the lower surface of the inner plate 5 there are disposed a first contact plate 10 and a rubber switch 18, which are fixed in place by being held between a printed board 12 and the inner plate 5 when both are connected together with screws 21. The combination of the inner plate 5 and the printed board 12 is in turn held in place by being held between the upper case 1 and the lower case 2 when both are joined together with screws 13.

The printed board 12 carries thereon an IC 14 including an oscillation circuit, a frequency divider circuit, etc. and though not shown, a quartz oscillator familiar in electronic watches, capacitors, etc., which are electrically wired together, whereby in this embodiment a basic watch mode, a calendar mode, an alarm mode, a timer mode and a stopwatch mode are obtained.

The IC 14 is provided with many functional terminals such as those shown in Table 1, which are connected to eleven patterns P1 to P11 and to liquid crystal drive terminals PL1, PL2, . . . PLn both on the printed board 12 in such a combination as in each line in the same table.

TABLE 1

| IC Terminals | Printed Board Patterns | First Contact Plate Terminals |
|---|---|---|
| Liquid Crystal Drive Terminal | PL1, PL2, . . . PLn | |
| Basic Time Mode Terminal | P1 | S1 |
| Calendar Mode Terminal | P2 | S2 |
| Alarm Mode Terminal | P3 | S3 |
| Timer Mode Terminal | P4 | S4 |
| Stopwatch Mode Terminal | P5 | S5 |
| Lock/Unlock Terminal | P6 | S6 |
| Alarm Set Terminal | P7 | S7 |
| Snooze Terminal | P8 | S8 |
| First External Operating Button Terminal | P9 | |
| Second External Operating Button Terminal | P10 | |
| Third External Operating Button Terminal | P11 | |

Among the above printed board patterns, the liquid crystal drive terminals PL1, PL2, . . . PLn are electrically connected through a zebra connector 15 to a clear electrode (not shown) formed on the liquid crystal display panel 3.

The first contact plate 10 has eight terminals including a first terminal S1, a second terminal S2, . . . an eighth terminal S8 with the terminals S1 to S8 corresponding to the printed board patterns P1 to P8 respectively in such a combination as in each line in Table 1 to form normally open switches.

Figure 6:
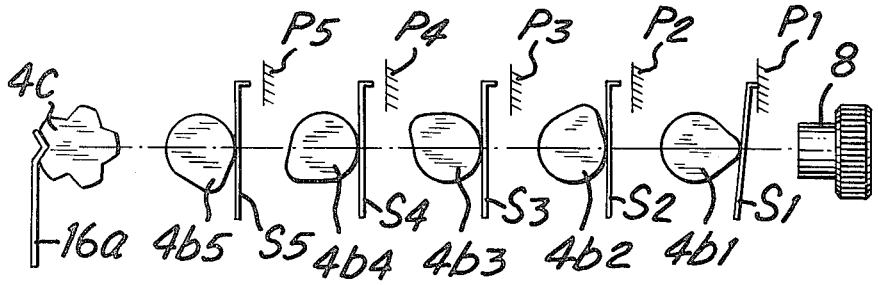
FIG. 6 is a partial operational view of FIG. 1.

On the other hand, the indication drum 4, as shown in FIG. 6, comprises three cylindrical indicating portions $4a_1$, $4a_2$, $4a_3$, first to fifth cams $4b_1$, $4b_2$, . . . $4b_5$ which are different in phase and are disposed in five equally divided portions in the rotational direction, a star wheel 4*c* mounted at the leftmost end and provided throughout its circumference with five equally spaced groove portions, and further a centrally formed oval hole 4*d*.

The selector shaft 9 is provided at an intermediate portion thereof with an oval shaft portion 9*a* which fits loosely in the oval hole 4*d* of the indication drum 4, and also with a click cam 9*b* between the oval shaft portion 9*a* and the knob 8. Both end portions of the selector shaft 9, as previously noted, are supported by the U-shaped grooves 5*d* of the inner plate 5 rotatably and axially movable.

Furthermore, the leftmost end of the selector shaft 9 is engaged with the sixth terminal S6 of the first contact plate, which terminal, when the selector shaft 9 moves to the right, connects to the sixth pattern P6 of the printed board thereby making valid the closing of the ninth to eleventh terminals P9, P10, P11.

Numeral 16 designates a presser plate affixed to the upper surface of the inner plate 5 with screws 17. The presser plate 16 is provided with a first arm 16*a* which engages the star wheel 4*c* of the indication drum 4 for imparting five equally divided click actions to the indication drum 4 when the latter is rotated, a second arm 16*b* which engages the click cam 9*b* of the selector shaft 9 for imparting a click action to the selector shaft 9 when the latter moves to the right or to the left, and third and fourth arms 16*c*, 16*d* which are in corresponding relation to the seventh and eighth terminals S7, S8 respectively, of the first contact plate.

The first to fifth cams $4b_1$, $4b_2$, . . . $4b_5$ of the indication drum 4 are engaged with the first terminal S1 to the fifth terminal S5 respectively, of the first contact plate, and the indication drum 4, as previously noted, is indexed into five equal parts throughout its circumference, so that, according to stop positions, the terminals S1 to S5 are connected to the printed board patterns P1 to P5 by the cams $4b_1$ to $4b_5$, and thus the different time modes are selected as shown in Table 1.

At the same time, mode indicating words shown by dotted lines at the lower portion of the liquid crystal display panel 3 in FIG. 1 are lit one by one to indicate the selected mode.

On the three cylindrical indication surfaces $4a_1$, $4a_2$, $4a_3$ of the indication drum 4, there are printed such characters as shown in Table 2 according to the selected mode, which characters are visible to the user through the sub-indication windows 1*b* of the upper case.

TABLE 2

| Mode | Indication Surface $4a_1$ | Indication Surface $4a_2$ | Indication Surface $4a_3$ |
|---|---|---|---|
| Basic Time Mode | HOUR | 10 MIN | 1 MIN |
| Calendar Mode | MONTH | DATE | DAY |
| Alarm Mode | HOUR | 10 MIN | 1 MIN |
| Timer Mode | START/CLEAR | 10 MIN | 1 MIN |
| Stopwatch Mode | START/STOP | LAP | RESET |

The first, second and third depressible push buttons 6*a*, 6*b*, 6*c* are disposed in corresponding relation to the subindication windows 1*b* of the upper case, and under each of the buttons 6*a*, 6*b*, 6*c* there is disposed a rubber switch 18, on the lower surface of which there is formed an electrically conductive portion 18*a* in corresponding relation to each of the buttons 6*a*, 6*b*, 6*c*. Consequently, when any of the buttons 6*a*, 6*b*, 6*c* is depressed, the electrically conductive portion 18*a* of the rubber switch 18 comes into contact with the corresponding terminal of the ninth to eleventh terminals P9, P10, P11 on the printed board and at the same time it contacts a ⊕ electrode pattern P+ formed on the printed board thereby connecting the two electrically. As a result, if the knob 8 is moved to the right and the sixth terminal S6 of the first contact plate is thereby connected to the sixth pattern P6 of the printed board, the operation of the buttons 6*a*, 6*b*, 6*c* becomes valid; for example, in the basic watch mode, if the first button 6*a* is depressed, the hour unit indication is modified by one hour, if the second button 6*b* is depressed, the 10 minute unit is advanced by 10 minutes, and if the third button 6*c* is depressed, the 1 minute unit is advanced by 1 minute.

In the calendar and alarm modes, the buttons 6*a*, 6*b*, 6*c* when depressed modify the time, or month, date and day as shown in Table 2 according to the selected mode.

In the timer mode, unlike the foregoing cases, a logic circuit is constituted so that the operation of the above buttons always becomes valid regardless of whether the selector shaft 9 is positioned to the right or the left. And with respect to the timer interval, the second button 6*b* effects an addition setting of the 10 minutes unit and the third button 6*c* effects an addition setting of the 1 minute unit. By the first depression of the first button 6*a* the timer starts, and this button when depressed a second time serves as a clear button. That is, in case it is desired to change the timer interval or stop the use of the timer after starting the timer, or in case it is desired to stop ringing of an alarm buzzer 20 upon termination of the timer interval after starting the timer, this may be done by a second depression of the first button 6*a* whereby the indications and the contents of the counter are all cleared and the ringing of the alarm buzzer 20 can be stopped.

Also in the stopwatch mode, the buttons 6*a*, 6*b*, 6*c* are constructed so that their operation becomes valid irrespective of the position of the selector shaft 9. That is, the first depression of the first button 6*a* allows counting to start, and by the first depression of the second button 6*b* the lap function starts operating and indication once stops. Then, the second depression of the second button 6*b* cancels the lap function and allows indication to return to the indication of the counter. And the second depression of the first button 6*a* effects suspension of the counter itself and stops indication and the counter's operation.

Further, the third button 6*c* functions effectively only while the counter stops operation, and its depression resets the counter and the contents of indication.

Thus, different clock functions at every selected mode are indicated in the indicator windows which are disposed in corresponding relation to the external operating buttons, so that the user can be easily aware of the function of each button.

This embodiment will be further explained here with respect to its construction. The alarm button 7 has a knurled portion on its upper surface so as to permit its easy operation from the exterior and also has on its lower surface a support portion 7*a* which engages the second guide portion 5*c* of the inner plate 5. Thus, the alarm button 7 is supported by the inner plate 5 from below and by the upper case 1 from above, and between the two, as previously noted, the alarm button 7 is movable right and left in FIG. 1 and is rotatable up and down in FIG. 7.

Furthermore, the alarm button 7 is provided on its lower surface with a projection 7*b* and a cam 7*c*, the cam 7*c* having a slant face 7*d*. When the alarm button 7 is moved from left to right, the slant face 7*d* depresses a bent portion of the third arm 16*c* of the presser plate, and the tip end of this bent portion connects the seventh terminal S7 of the first contact plate to the seventh pattern P7 of the printed board whereby the alarm buzzer 20 can operate upon arrival of a preset alarm time.

The projection *7b* of the alarm button 7 is engaged with the fourth arm 16*d* of the presser plate and is thereby given an upwardly biasing force at all times. The alarm button 7 undergoes a click action by getting over a click projection 16*e* formed on the surface of the fourth arm 16*d*.

When the alarm button 7 is depressed by the user, as previously noted, the projection *7b* of the alarm button forces down the fourth arm 16*d* against the biasing force of the latter; as a result, the bent portion of the fourth arm 16*d* connects the eighth terminal S8 of the first contact plate to the eighth pattern P8 of the printed board. The terminal S8 is a snooze function terminal familiar in watch structure, and by connecting it to the eighth pattern P8 of the printed board when the alarm buzzer begins ringing, it is made possible to stop the operation of the buzzer 20 and allow it to ring again after approximately five minutes.

Figure 8:
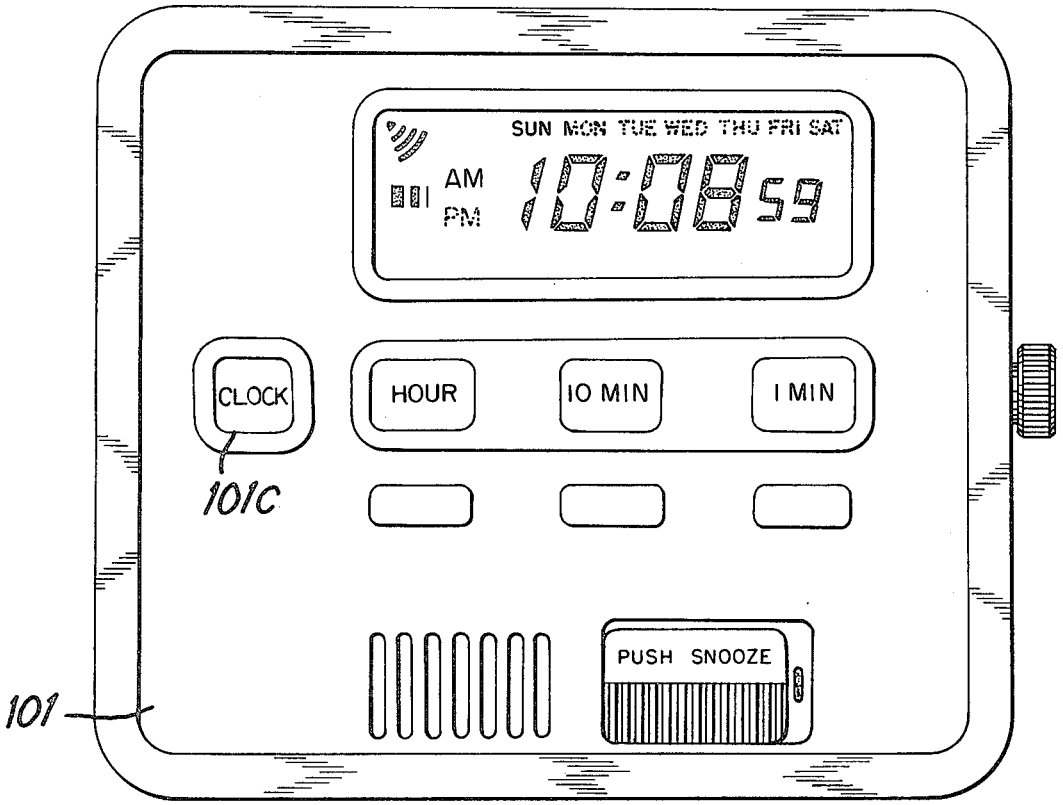
FIG. 8 is a plan view of a mode switching device according to another embodiment of this invention.
Figure 9:
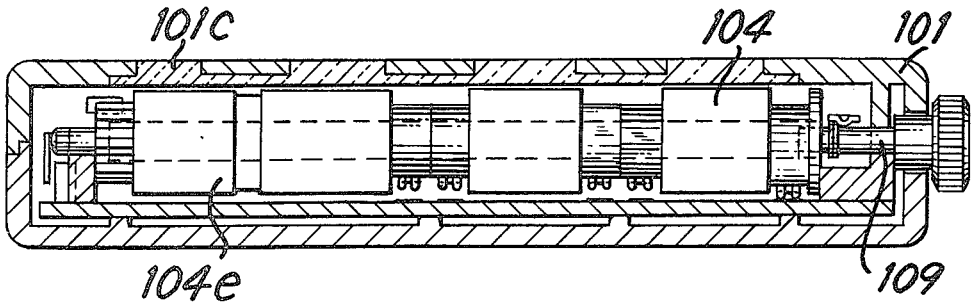
FIG. 9 is a partial sectional view thereof.
Figure 7:
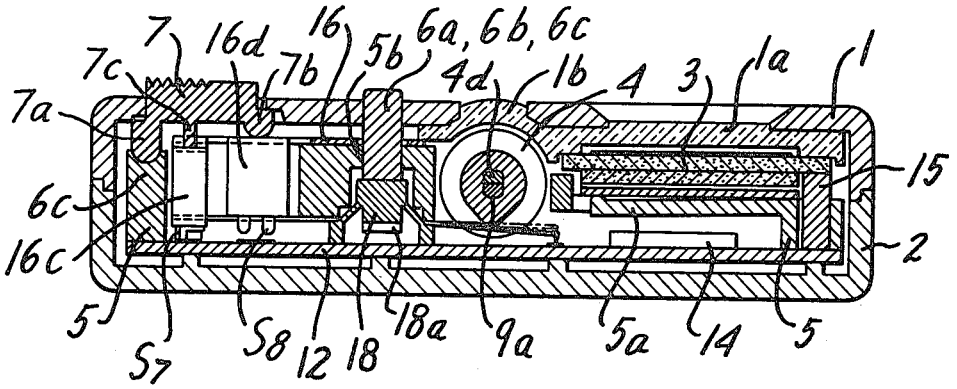
FIG. 7 is a partial sectional view of FIG. 1.

A second embodiment of this invention will be described hereinunder with reference to FIGS. 8 and 9, but the explanation will be given only about portions different from the foregoing first embodiment.

An indication drum 104 is different from the indication drum used in the first embodiment only in that it is further provided with a mode-indicating portion 104*e*.

On the surface of the mode indicating portion 104*e* are inscribed characters or marks for indicating the contents of a selected mode when a selector shaft 109 rotates for the selection of a mode.

The reference numeral 101 designates an upper case. The upper case 101 is different from the upper case used in the first embodiment only in that it is further provided with a second sub-indication window 101*c*. In an opposed position to the second sub-indication window 101*c* there is disposed the mode indicating portion 104*e* of the indication drum so that the contents of modes can be seen from the second sub-indication window 101*c* as the selector shaft 109 rotates.

In the foregoing first embodiment, a selected mode is indicated by lighting mode-indicating characters which are of small size and disposed at the lower portion of the liquid crystal display panel 3, and actually the size of those characters becomes very small because of a limited space of their arrangement for indicating modes. In addition, their design must be made small in view of their relation to the time-indicating portion, and because of these limitations the selected mode is difficult to be seen. In this second embodiment, however, a selected mode is indicated in a separate indication window and this indication can be made mechanically, so it is very easy to see the selected mode.

In the foregoing description of the embodiments, the indication drum 4 or 104 is formed in the shape of a drum, however, even if it is formed of a disk and the operational contents of the external operating buttons are inscribed on its surface, there can be attained the same effect.

In the foregoing embodiments, the cams for actuating the mode selecting switches are formed integrally with the indication drum 4 or 104, but they may be integral with the selector shaft 9 or 109 whereby the same effect can be attained.

According to this invention, as set forth hereinabove, not only the foregoing object is attainable, but also the function of each external switch-button can be made definite while reducing the number of those buttons, so that this invention is advantageous in the aspects of space and cost and it can be designed in a very simple form.

We claim:

1. In a multi-mode electronic timepiece operable in a plurality of different selectable clock function modes: manually rotatable mode selection means for selecting any one of the plurality of different clock function modes; first indicating means for indicating the clock function of the selected mode; adjusting means including a plurality of depressible push buttons operative when depressed to effect adjustment of the contents of indication of the first indicating means; and second indicating means cooperative with the mode selection means for indicating the function of each push button with respect to the selected mode, the second indicating means comprising a plurality of indication surfaces at least corresponding in number to the number of said push buttons, and each indication surface carrying thereon indicia which indicates the function of a corresponding one of the push buttons with respect to the selected mode.

2. In a multi-mode electronic timepiece according to claim 1; wherein the second indicating means has at least one more indication surface than the number of push buttons, and said one more indication surface has thereon indicia indicating the selected mode.

3. In a multi-mode electronic timepiece according to claim 1; wherein the mode selection means includes a rotatable shaft having a mode indicating surface having thereon indicia for indicating the selected mode.

4. In a multi-mode electronic timepiece according to claim 1; wherein the mode selection means includes a rotatable shaft, mounting means for mounting said shaft for both axial and rotational movement; and lock means operated by axial movement of said shaft for disabling said push buttons to render same ineffective to adjust the contents of indication of the first indicating means.

5. In a multi-mode electronic timepiece according to claim 1; including means mounting the mode selection means so as to be displaceable in a second direction different from a first direction of movement for mode selection, and lock means operative to select whether the command of each push button is valid or invalid, said lock means interlocking with the displacement in the second direction of said mode selection means.

6. In a multi-mode electronic timepiece according to claim 5; further including indexing means for stopping said mode selection means according to each mode position as said mode selection means moves in the first direction, a mode switch corresponding to each one of the plurality of different modes for the selection of each mode, and cam means responsive to said mode selection means for actuating the mode switches.

7. In a multi-mode electronic timepiece according to claim 6; wherein the second indicating means includes a star wheel for the indexing and said cam means formed integrally with each other.

8. In a multi-mode electronic timepiece according to claim 1; wherein the mode selection means comprises a manually rotatable shaft, the indication surfaces of the second indicating means which indicate the function of each push button being connected to the shaft for rotation therewith.

9. In a multi-mode electronic timepiece according to claim 8; wherein the mode selection means further includes a plurality of cams connected axially along the shaft for rotation therewith, and a plurality of contact switches cooperative with the cams so that rotation of the shaft causes the cams to selectively open and close the contact switches for selecting the mode.

* * * * *